US007347420B2

(12) United States Patent
Kobayashi et al.

(10) Patent No.: US 7,347,420 B2
(45) Date of Patent: Mar. 25, 2008

(54) SHEET TRANSPORT APPARATUS AND IMAGE FORMING APPARATUS

(75) Inventors: Shinsuke Kobayashi, Shizuoka (JP); Michihito Yamazaki, Tokyo (JP); Yasuzumi Taba, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 459 days.

(21) Appl. No.: 10/781,810

(22) Filed: Feb. 20, 2004

(65) Prior Publication Data

US 2004/0169329 A1 Sep. 2, 2004

(30) Foreign Application Priority Data

Feb. 27, 2003 (JP) ..... 2003-052022

(51) Int. Cl.
*B65H 5/02* (2006.01)

(52) U.S. Cl. ..... 271/272; 271/2; 271/264

(58) Field of Classification Search ..... 271/2, 271/314, 264, 272
See application file for complete search history.

(56) References Cited

U.S. PATENT DOCUMENTS

| | | | | |
|---|---|---|---|---|
| 4,915,369 | A * | 4/1990 | Rutishauser | 271/2 |
| 5,114,337 | A | 5/1992 | Yamazaki | 432/8 |
| 5,210,579 | A | 5/1993 | Setoriyama et al. | 355/285 |
| 5,708,926 | A * | 1/1998 | Sagara et al. | 399/122 |
| 5,826,141 | A * | 10/1998 | Mitsuya | 399/122 |
| 5,994,671 | A | 11/1999 | Suzuki et al. | 219/216 |
| 6,040,558 | A | 3/2000 | Yamazaki | 219/216 |
| 6,631,252 | B2 * | 10/2003 | Ando et al. | 399/328 |
| 2003/0077092 | A1 | 4/2003 | Ogawa et al. | 399/328 |

FOREIGN PATENT DOCUMENTS

| | | |
|---|---|---|
| JP | 4-204980 | 7/1992 |
| JP | 5-1477640 | 6/1993 |
| JP | 2002-316733 | 10/2002 |

* cited by examiner

*Primary Examiner*—Patrick Mackey
*Assistant Examiner*—Kaitlin S Joerger
(74) *Attorney, Agent, or Firm*—Fitzpatrick, Cella, Harper & Scinto

(57) ABSTRACT

A sheet transport apparatus which includes a sheet transport path for transporting a sheet, and a regulation member. The regulation member is provided in the sheet transport path, and is brought into contact with a swelling portion occurring on a surface of an envelope in the event that the envelope is transported as the sheet, such that the swelling portion can be pressed.

4 Claims, 15 Drawing Sheets

FIG. 6

| MOISTURE CONTENT [%] | WITHOUT RIB (CONVENTIONAL ART) | WITH RIB (THE EMBODIMENT) |
|---|---|---|
| 8.0 | 0 | 0 |
| 8.5 | 0 | 0 |
| 9.0 | 0 | 0 |
| 9.5 | 1 | 0 |
| 9.7 | 2 | 0 |
| 10.0 | 3 | 0 |
| 10.2 | 5 | 0 |
| 10.5 | 7 | 0 |
| 10.7 | 8 | 0 |
| 11.0 | 7 | 2 |
| 11.3 | 8 | 4 |
| 11.5 | 9 | 5 |
| 11.7 | 10 | 8 |
| 12.0 | 10 | 10 |

FIG. 8A

| MOISTURE CONTENT [%] | WITHOUT RIB (CONVENTIONAL ART) | FIRST EMBODIMENT | SECOND EMBODIMENT |
|---|---|---|---|
| 8.0 | 0 | 0 | 0 |
| 8.5 | 0 | 0 | 0 |
| 9.0 | 0 | 0 | 0 |
| 9.5 | 1 | 0 | 0 |
| 9.7 | 2 | 0 | 0 |
| 10.0 | 3 | 0 | 0 |
| 10.2 | 5 | 0 | 0 |
| 10.5 | 7 | 0 | 0 |
| 10.7 | 8 | 0 | 0 |
| 11.0 | 7 | 2 | 0 |
| 11.3 | 8 | 4 | 0 |
| 11.5 | 9 | 5 | 0 |
| 11.7 | 10 | 8 | 1 |
| 12.0 | 10 | 10 | 3 |

FIG. 8B

| FIRST EMBODIMENT | SECOND EMBODIMENT |
|---|---|
| 1.2 | 0.5 |

SHEET TRANSPORT APPARATUS AND IMAGE FORMING APPARATUS

BACKGROUND OF THE INVENTION

1. Field of the Invention

The present invention relates to an image forming apparatus, such as a copying machine and a printer, and a sheet transport apparatus capable of being provided in the image forming apparatus.

2. Related Background Art

In recent years, in an image forming apparatus, such as a copying machine and a laser beam printer using an electrophotographic process, for example, a toner image formed on a photosensitive drum provided in an image forming portion is transferred to a sheet supplied to the image forming portion by a sheet feeding portion, and the toner image is then fixed by a fixing portion. Among such conventional image forming apparatuses, there exists an apparatus in which a sheet transport path from the sheet feeding portion to the fixing portion is largely curved such that the size of the apparatus can be reduced.

FIG. 9 is a schematic view illustrating the structure of a laser beam printer which exemplifies such a conventional image forming apparatus.

In FIG. 9, reference numeral 101 designates a photosensitive drum serving as an image bearing member. Reference numeral 102 designates a charging roller serving as charging means. Reference numeral 103 designates a laser scanner serving as exposing means. The intensity of laser light is modulated by the laser scanner 103 based on an image information signal supplied from a host computer (not shown), and the modulated laser light is projected on the photosensitive drum 101, a surface of which is uniformly charged by the charging roller 102, such that an electrostatic latent image can be formed thereon.

The thus-formed electrostatic latent image is then carried to an opposing portion between a developing device 104 and the photosensitive drum 101 by the rotation of the photosensitive drum 101 in a direction indicated by an arrow, and is sequentially developed by the developing device 104. The toner image developed by the developing device 104 is then sequentially transferred to a sheet P, which is supplied to a transferring portion T from a pick-up roller 105, by a transferring roller 106.

The sheet P, to which the toner image is thus transferred, is separated from the photosensitive drum 101 in synchronous motion with the rotation of the photosensitive drum 101, and is fed to a fixing device 107. The sheet P is heated and pressed in the fixing device 107, and the toner image on the sheet is fixed as a permanent fixed image. Residual toner remaining on the photosensitive drum is collected by a cleaner container 118.

An apparatus of a heat roller system is conventionally used widely as the fixing device 107 for heating and fixing such an unfixed image (the toner image) on a recording surface of the sheet as the permanent fixed image. However, as disclosed in Japanese Patent Application Laid-Open No. H4-204980, a fixing device of a film heating system has been recently put into a practical use in the light of capability of quick start and reduction of energy.

As illustrated in FIG. 9, such a fixing device has, for example, a structure in which a heat resisting fixing film (or a fixing belt) 111 is sandwiched between a ceramic heater 110 serving as a heating member and a pressing roller 109 serving as a pressing member to establish a fixing nip portion, and when the sheet bearing the unfixed toner image to be fixed is introduced into the fixing nip portion between the fixing film 111 and the pressing roller 109, the sheet is nipped and conveyed together with the fixing film 111.

In such an event that the recording material is nipped and conveyed by the pressing roller 109 and the fixing film 111, heat of the ceramic heater 110 is transmitted to the recording material through the fixing film 111 in the fixing nip portion, and the unfixed toner image is thermally pressure-fixed onto the surface of the recording material by pressure applied in the fixing nip portion.

On the other hand, among conventional image forming apparatuses, there has been proposed an apparatus which is capable of forming an image on an envelope, as well as recording an image on a sheet P. An example of such an envelope is illustrated in FIG. 10A, and FIG. 10B which is a cross-sectional view taken along a line XB-XB in FIG. 10A. In FIGS. 10A and 10B, reference numeral 20 designates an envelope, reference numerals 21 and 22 designate a pair of structural pieces constructing front and back surfaces of the envelope 20, and reference numeral 23 designates a flap portion on which an adhesive for sealing is to be applied.

FIGS. 11A to 11C, and FIGS. 12A and 12B illustrate two kinds of envelopes. FIGS. 11A to 11C illustrate a COM10 envelope or a DL envelope which is generally used in Europe and United States, and in which the flap portion 23 (an opening portion) is provided on a longer side of a rectangle. On the other hand, FIGS. 12A and 12B illustrate an envelope which is widely used in Japan, and in which the flap portion 23 (an opening portion) is provided on a shorter side of a rectangle.

When the envelope undergoes printing (image formation) in the image forming apparatus, either envelope is generally inserted in the apparatus with its longer side of the rectangle being aligned to a longitudinal direction.

However, in a conventional image forming apparatus adapted to form an image on such an envelope, a wrinkle is likely to occur on the envelope, especially on the envelope of such a type as illustrated in FIGS. 11A to 11C, in the event that the envelope passes through the fixing device 107. The reason for occurrence of the envelope wrinkle will be described.

The envelope 20 is basically formed with a sheet of paper as illustrated in the development of FIG. 11C. In general, printing (image formation) is carried out on a front side of the envelope 20, and the envelope is transported with the front side (a print surface) being in contact with a heating side (a side of the fixing film) in the fixing device 107. Therefore, especially in a case of the envelope 20 containing much moisture, moisture of the surface being heated is chiefly evaporated, and this side is hence quickly shrunk in the fixing nip portion.

On the other hand, a back side of the envelope 20 is provided with a pasted overlap width portion as illustrated in the development of FIG. 11C, and the envelope is transported with the back side being in contact with a pressing side (a side of the pressing roller) in the fixing device 107. Accordingly, the back side is difficult to shrink in the fixing nip portion, as compared with the front side. In other words, when the envelope containing much moisture passes through the fixing device 107, its front side shrinks whereas its back side does not shrink, as illustrated in FIG. 13B.

Further, where the envelope 20 contains much moisture, the front side of the envelope 20 is likely to wave, and swelling portions is likely to unevenly appear as illustrated in FIG. 14A. Occurrence of swelling portions on the front side of the envelope 20 is accompanied by a fact that air is introduced into the envelope as illustrated in FIG. 14B.

In the event that the envelope 20 is passed through the fixing device 107 under such an air-introduced condition as illustrated in FIG. 15A, moisture in the swelling portion is evaporated in the fixing nip portion, and the swelling portion abruptly shrinks, leading to appearance of slight deformation in the envelope 20 as illustrated in FIG. 15B. During the passage of the envelope 20 as illustrated in FIG. 15C, the wrinkle hence appears from a starting point of a portion of that deformation to a trailing end of the envelope 20. To paraphrase the above, the envelope wrinkle is very likely to occur when air is introduced into the envelope at the time of fixation.

Turning back to FIG. 9, the sheet P fed out from the pick-up roller 105 is passed through a largely curved sheet transport path 120, and is fed to the transferring portion T. During the passage through the sheet transport path 120, the sheet P is conveyed while being curved upward along the sheet transport path 120.

Where the sheet P is an envelope which is comprised of a sheet of paper, the swelling portion occurs on its inner-side surface, which is a front surface on a folding side, due to the folding, as illustrated in FIG. 16A. FIG. 16B illustrates a folding angle. For example, in the case of the envelope 20 as illustrated in FIGS. 11A to 11C, a swelling portion slightly appears on its inner-side surface when the folding angle amounts to over 30 degrees. In such an event, the wrinkle occurs as discussed above during the passage of the envelope through the fixing device 107.

To paraphrase the above, the envelope wrinkle is likely to occur, where the envelope contains much moisture, and air is introduced into the envelope, and the swelling portion is present on the surface of the envelope when it reaches the fixing portion.

SUMMARY OF THE INVENTION

It is an object of the present invention, in view of the above-discussed situation, to provide a sheet transport apparatus capable of preventing occurrence of a wrinkle on a sheet (an envelope) during its passage through a fixing portion, and an image forming apparatus.

Further, it is an object of the present invention to provide a sheet transport apparatus which includes a sheet transport path for transporting a sheet, and a regulation member which is provided in the sheet transport path, and is brought into contact with a swelling portion occurring on a surface of an envelope to press the swelling portion in the event that the envelope is transported as the sheet.

Furthermore, it is an object of the present invention to provide a sheet transport apparatus which includes a sheet transport path for transporting a sheet, and a regulation member which is provided in the sheet transport path with being a predetermined distance spaced from an envelope to be transported in the event that the envelope is transported as the sheet.

These and further aspects and features of the invention will become apparent from the following detailed description of preferred embodiments thereof in conjunction with the accompanying drawings.

BRIEF DESCRIPTION OF THE DRAWINGS

FIG. 6 is a table showing the relationship between presence or absence of the rib, the moisture content, and the number of sheets with a wrinkle occurring thereon;

FIG. 8A is a table showing the relationship between presence or absence of the rib, presence or absence of an auxiliary roller, the moisture content, and the number of sheets with a wrinkle occurring thereon;

FIG. 8B is a table showing an average of absolute values and the maximum value of a difference in stretch between right and left stretched image portions measured from the first sheet to the tenth sheet;

DESCRIPTION OF THE PREFERRED EMBODIMENTS

Embodiments of the present invention will be described with reference to the drawings.

Figure 1:
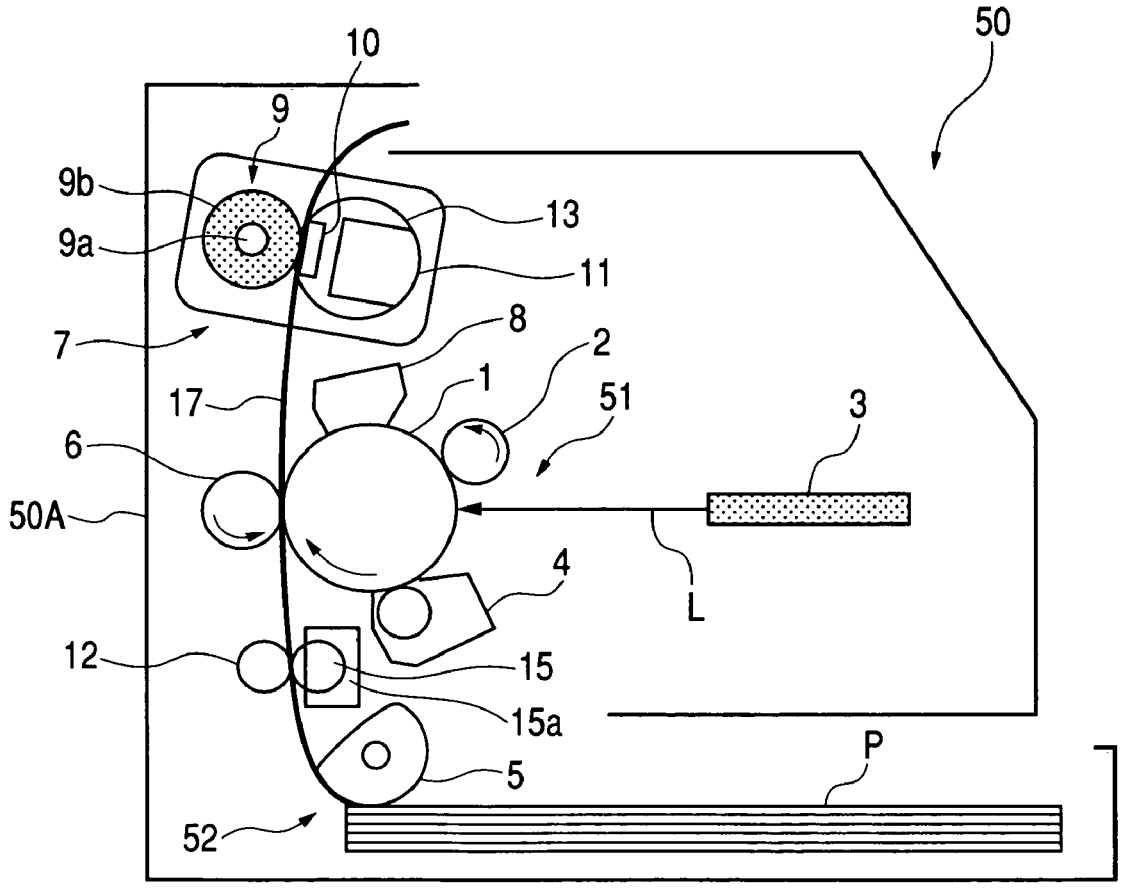
FIG. 1 is a view schematically illustrating the structure of an image forming apparatus of a first embodiment according to the present invention.

FIG. 1 illustrates the schematic structure of an image forming apparatus of a first embodiment according to the present invention. In FIG. 1, reference numeral 50 designates an image forming apparatus, and reference numeral 50A designates a body of the image forming apparatus. The main body 50A of the image forming apparatus (hereinafter referred to simply as the main body) is provided with an image forming portion 51 for forming an image in an electrophotographic process, a sheet feeding portion 52 for feeding a sheet to the image forming portion 51, and a fixing device 7.

In the image forming portion 51, there are arranged a photosensitive drum 1 serving as an image bearing member, a charging device 2 serving as charging means, a laser scanner 3 serving as exposing means, and a developing device 4. The intensity of laser light L is modulated by the laser scanner 3 based on an image information signal supplied from a host computer, and the photosensitive drum 1, whose surface is uniformly charged by the charging device 2, is illuminated with the modulated light such that an electrostatic latent image can be formed on the surface.

The electrostatic latent image is transported to an opposing portion between the developing device 4 and the photosensitive drum 1 by the rotation of the photosensitive drum 1 in a direction indicated by an arrow, and is sequentially developed by the developing device 4. The thus-developed toner image is sequentially transferred to a sheet P, which is supplied from a sheet feeding roller 5 of the sheet feeding portion 52 through a portion between a transport roller 12 and a transport runner 15, by a transferring device 6.

Thereafter, the sheet P with the transferred toner image is separated from the photosensitive drum 1 in synchronous motion with the rotation of the photosensitive drum 1, and is fed to the fixing device 7. The sheet P is heated and pressed in the fixing device 7, and the toner image on the sheet is fixed as a permanent fixed image. Residual toner remaining on the photosensitive drum 1 is collected by a cleaner container 8.

The fixing device 7 is of a so-called tension less type operative in a film heating method and a pressing rotor driving method. The fixing device 7 is provided with a heat-resisting rigid member 13 for guiding a film inner surface, a heater 10 which is fit into and fixed to a recess groove formed in the film-inner-surface guide member 13 along a width direction perpendicular to a sheet transport direction, and which is to be heated by supply of electric current, a fixing film 11 provided on the periphery of the film-inner-surface guide member 13 with the heater 10 fit therein, and a pressing roller 9 serving as a pressing rotor.

In this embodiment, the heater 10 is a so-called ceramic heater, for example. The fixing film 11 is a cylindrical member with its outer circumferential length of about 57 mm, which is formed of a heat-resisting resin such as polyimide. Further, the inner circumferential length of the fixing film 11 is set 3 mm longer than the outer circumferential length of the film-inner-surface guide member 13 with the heater 10 fit therein, such that the film-inner-surface guide member 13 with the heater 10 can be loosely surrounded by the fixing film 11 with an allowance of a circumferential length.

The pressing roller 9 serving as a driving roller is comprised of a core metal 9*a*, and an elastic layer 9*b* which is integrally formed around the core metal 9*a* concentrically therewith, and is formed of a heat-resisting rubber, such as silicone rubber and fluorocarbon rubber, a foamed silicone rubber, or the like. The fixing film 11 is sandwiched between the pressing roller 9 and the film-inner-surface guide member 13 including the heater 10.

In FIG. 1, reference numeral 15*a* designates a transport runner holder serving as holding means for holding in a freely rotatable manner the transport runner 15 constituting a rotor pair together with the transport roller 12. The transport runner 15 is supported by the transport runner holder 15*a* through a transport runner support (not shown). A transport spring (not shown) is provided between the transport runner support and the transport runner holder 15*a* such that transport force can be created at the transport roller 12 and the transport runner 15.

As illustrated in FIG. 1, the fixing device 7 constituting the fixing portion is disposed above the sheet feeding roller 5 serving as sheet feeding means with respect to a vertical direction. Accordingly, in this embodiment, the sheet P fed from the sheet feeding roller 5 is transported to the fixing device 7 via a curved sheet transport path 17 which extends upward in an approximately vertical direction.

Figure 2:
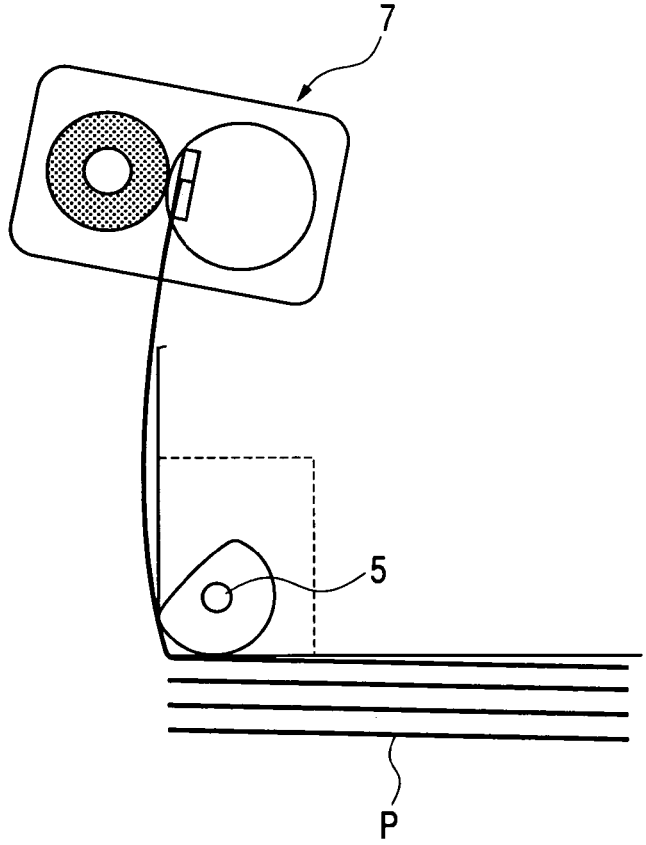
FIG. 2 is a view illustrating an angle of a sheet transported by a sheet feeding roller and a fixing device of the image forming apparatus.

In the first embodiment, the distance between the sheet feeding roller 5 and the fixing device 7 is set to 120 mm, and accordingly there is a possibility to bring forth a case where the sheet P fed out from the sheet feeding roller 5 is transported by both the sheet feeding roller 5 and the fixing device 7 as illustrated in FIG. 2. Under such a condition, the sheet P is bent at an angle of about 90 degrees.

Figure 16A:
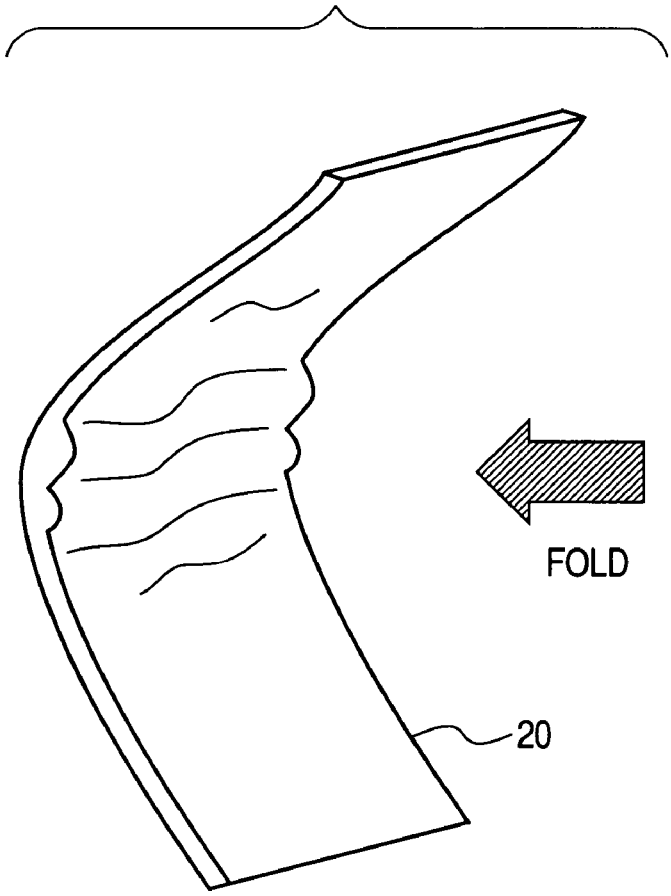
FIG. 16A is a view illustrating a swelling portion of a conventional envelope at the time when it is folded.
Figure 16B:
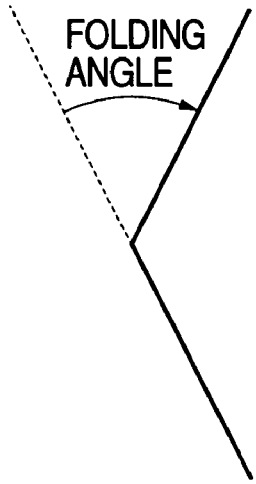
FIG. 16B is a view illustrating a folding angle.

More specifically, since there is provided the sheet transport path 17 curved in the approximately vertical direction in the above manner, the sheet P transported by the sheet feeding roller 5 is curved along the sheet transport path 17 when the sheet P enters the sheet transport path 17. Therefore, in the event that an envelope is transported as the sheet P, a swelling portion is liable to occur on an inner-side surface of the envelope (see FIG. 16A).

Figure 3:
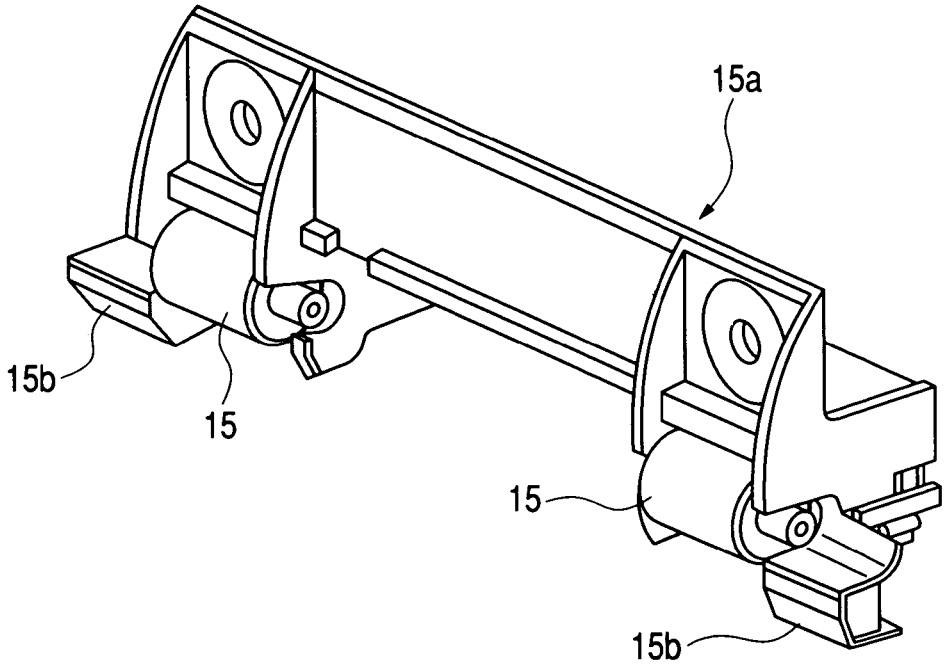
FIG. 3 is a perspective view schematically illustrating a transport runner holder of the image forming apparatus.

In this embodiment, accordingly, a rib 15*b* serving as a regulation member is provided at each end portion of the transport runner holder 15*a* in its width direction perpendicular to the sheet transport direction, as illustrated in FIG. 3, so that occurrence of a swelling portion on the envelope can be regulated. The tip end of the rib 15*b* is located at a spaced position from the transport guide 16 by a predetermined distance. When the envelope is passed through the apparatus as the sheet P, the rib 15*b* is brought into contact with the swelling portion occurring on a surface of the envelope on its curving side, i.e., on its inner-side surface, to press the swelling portion. Air introduced into the envelope prior to its entrance into the fixing device 7 can be exhausted by such pression of the swelling portion on the inner-side surface of the envelope 20. In addition, a taper 15*c* is formed on the side of the rib 15*b* which the envelope enters so as to gradually press the swelling portion of the envelope so that the air can be exhausted surely.

Figure 4A:
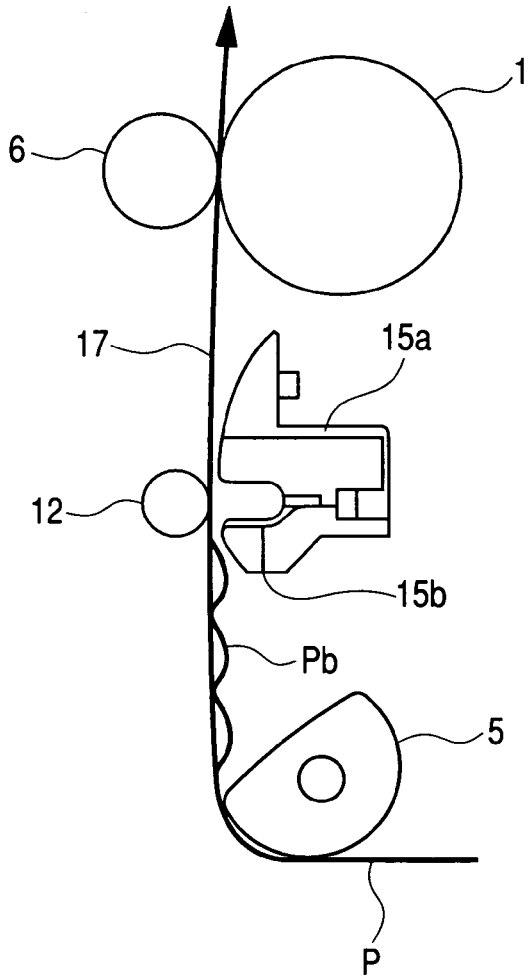
FIG. 4A is a view illustrating a manner in which a swelling portion on a surface of an envelope is pressed by a rib mounted to the transport runner holder.
Figure 4B:
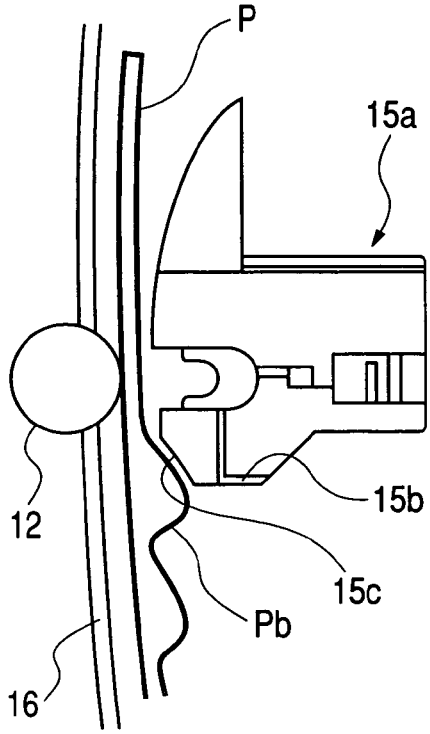
FIG. 4B is an enlarged view illustrating the rib and the swelling portion on the surface of the envelope.

FIG. 4A illustrates a manner in which the swelling portion on the surface of the envelope is pressed by the rib 15*b*. FIG. 4B is an enlarged view illustrating the rib 15*b* and a swelling portion Pb on the surface of the envelope. The rib 15*b* is brought into contact with the swelling portion Pb occurring on the surface of the curved envelope 20 on its inner side at the time when it is fed out by the sheet feeding roller 5 forming an angle, thereby pressing the swelling portion Pb. In this embodiment, the rib 15*b* is formed of ABS resin or the like.

The rib 15*b* is thus provided in the transport runner holder 15*a*, and the rib 15*b* is brought into contact with the swelling portion of the envelope, thereby exhausting air in the envelope. Accordingly, shrinkage due to abrupt evaporation of moisture at the fixing nip portion can be prevented, and hence deformation caused by this shrinkage can be avoided. Thus, occurrence of the wrinkle can be drastically reduced.

Figure 5:
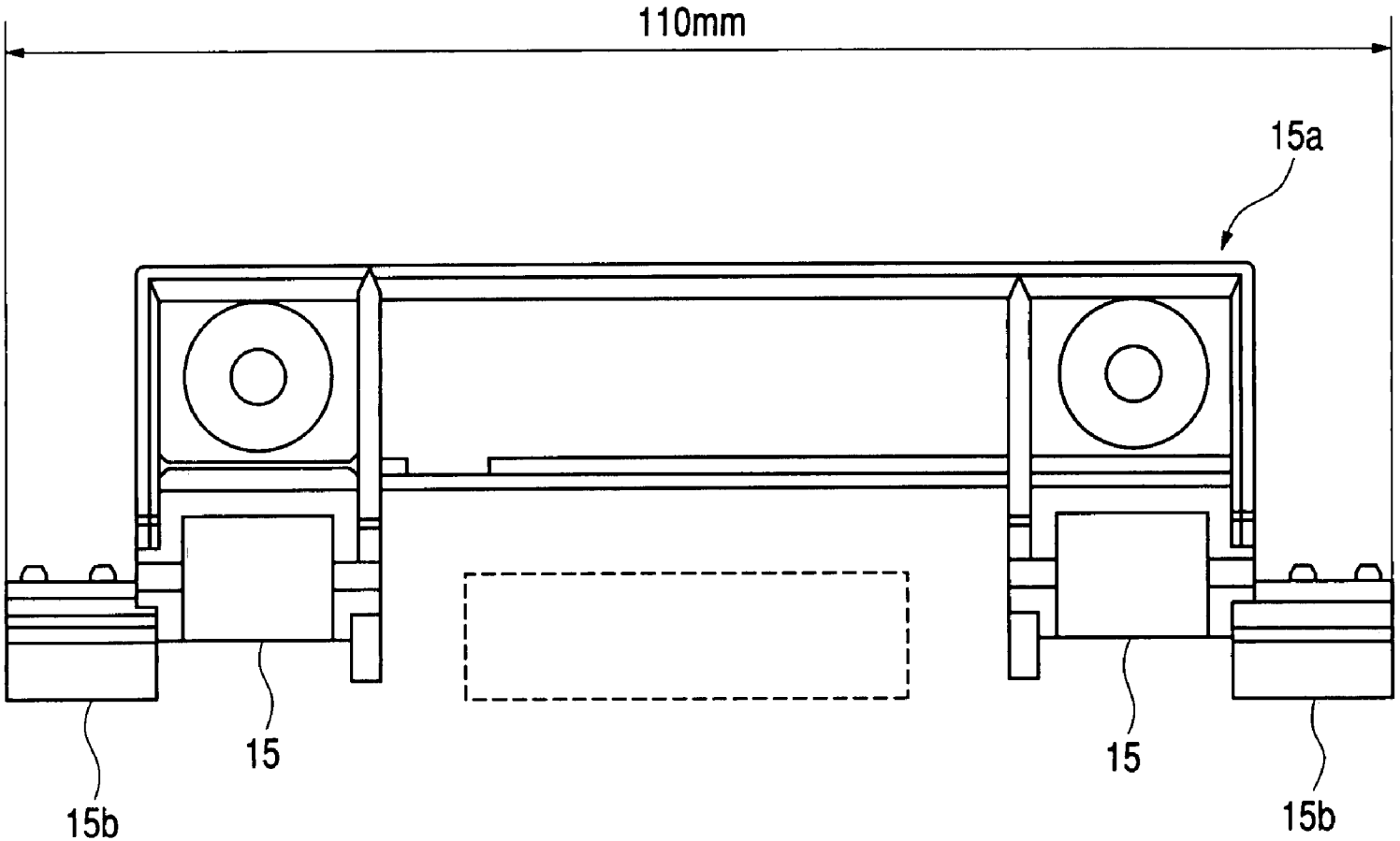
FIG. 5 is a front view illustrating the transport runner holder of the image forming apparatus.
Figure 11A:
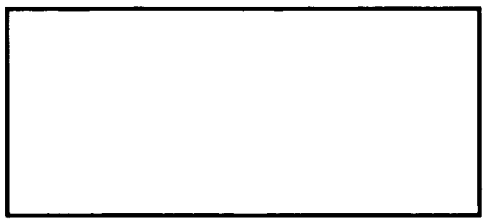
FIG. 11A is a view illustrating a front side (a print surface) of a COM10 which is an example of a conventional envelope.
Figure 11B:
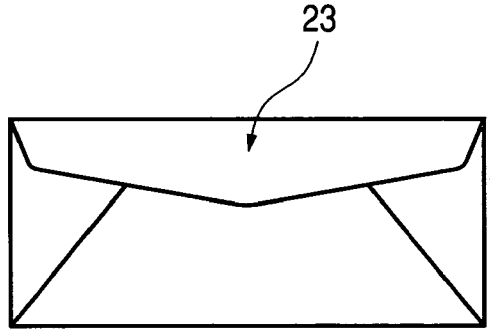
FIG. 11B is a view illustrating a back side of the COM10.
Figure 11C:
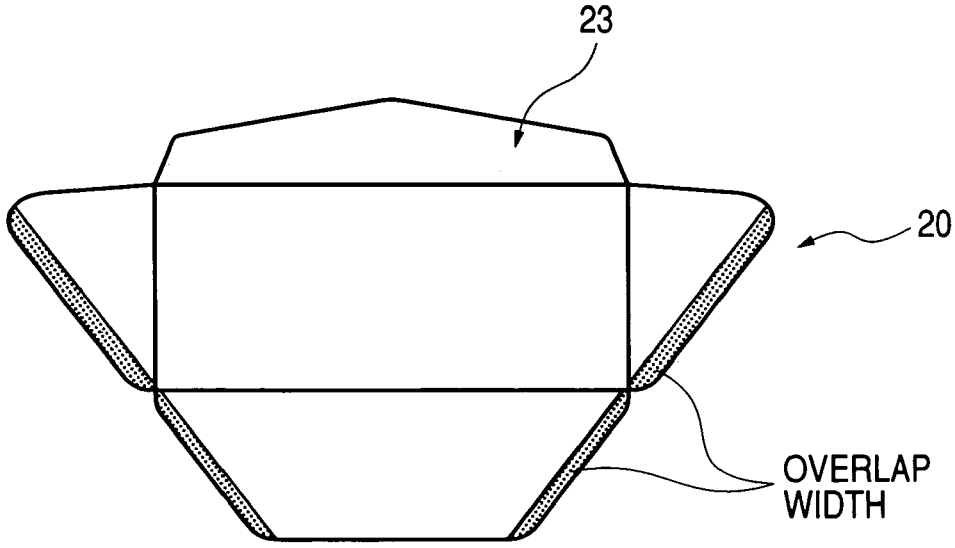
FIG. 11C is a development view illustrating the COM10.
Figure 12A:
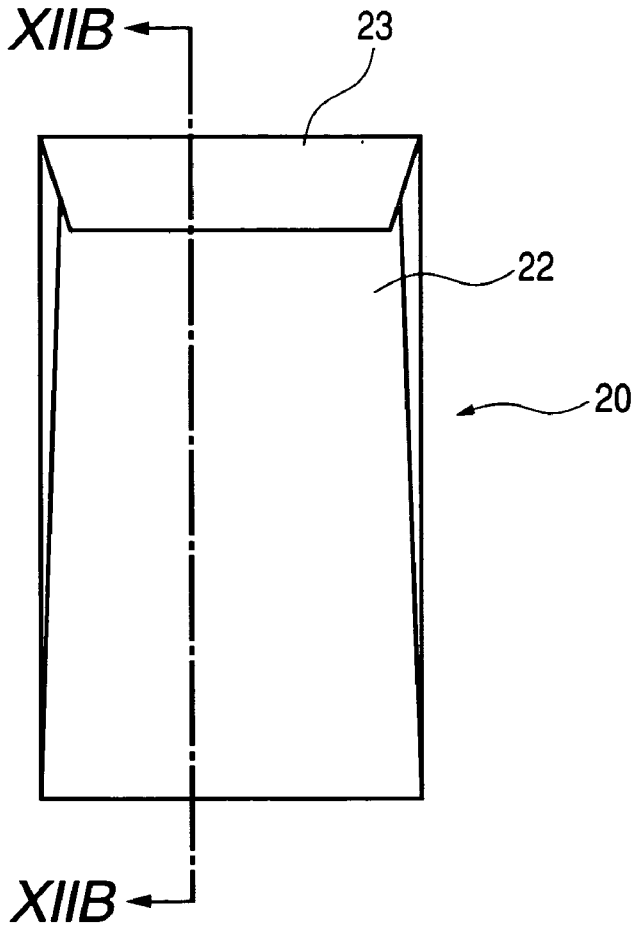
FIG. 12A is a view illustrating an example of an envelope which is generally used in Japan.
Figure 12B:
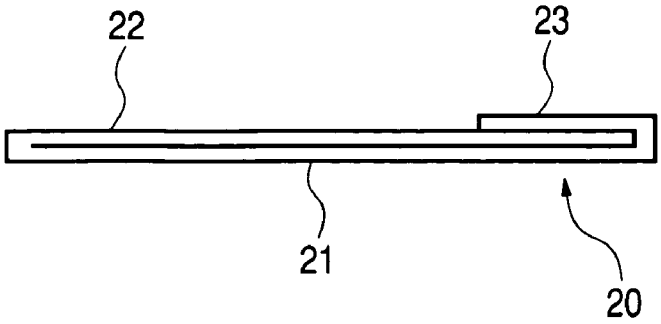
FIG. 12B is a cross-sectional view taken along a line XIIB-XIIB of FIG. 12A.
Figure 13A:
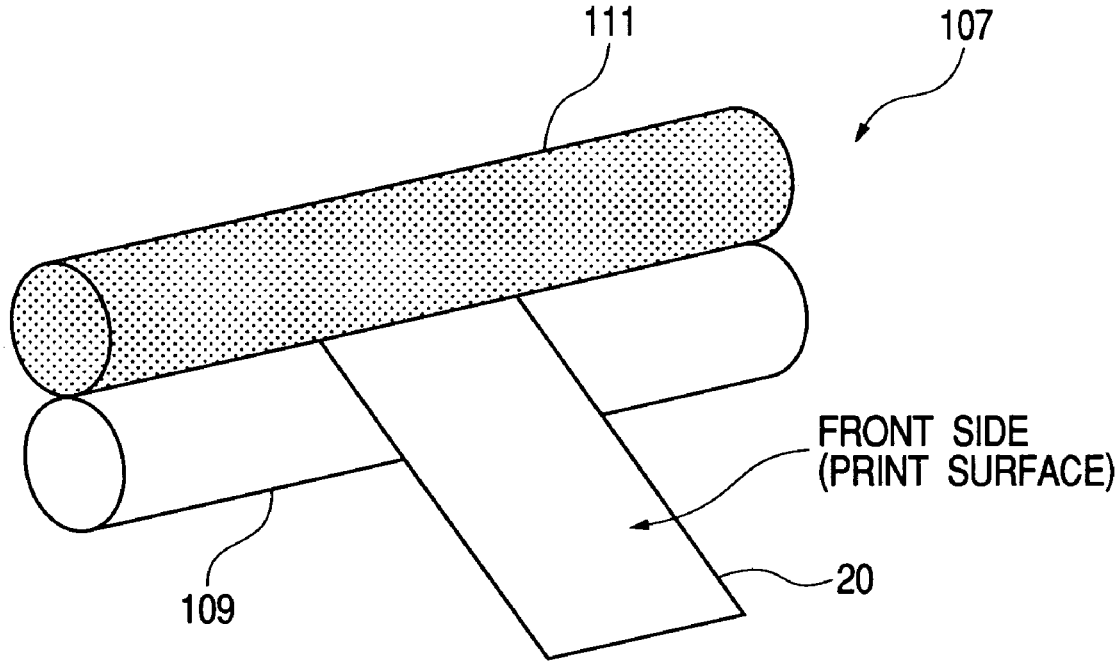
FIG. 13A is a view illustrating a manner in which an envelope thrusts into a fixing portion of a conventional image forming apparatus.
Figure 13B:
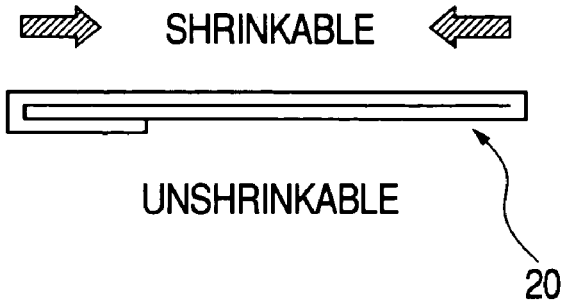
FIG. 13B is a cross-sectional view illustrating shrinkable and unshrinkable sides of the envelope.
Figure 14A:
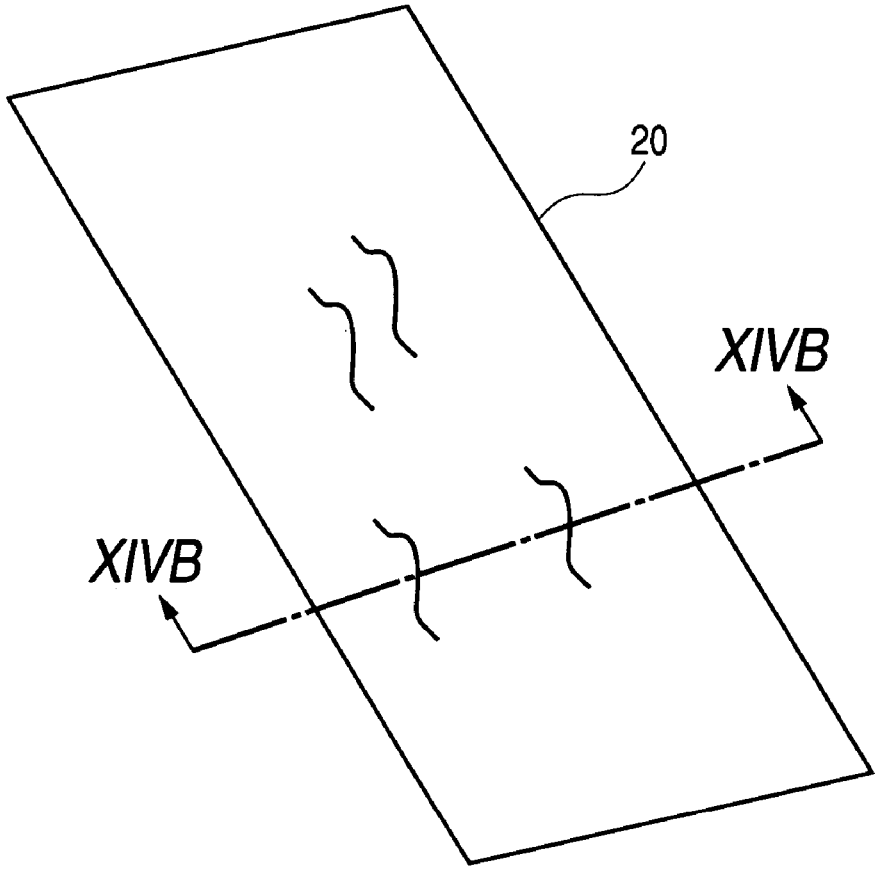
FIG. 14A is a view illustrating a waving condition of a surface of a conventional envelope.
Figure 14B:
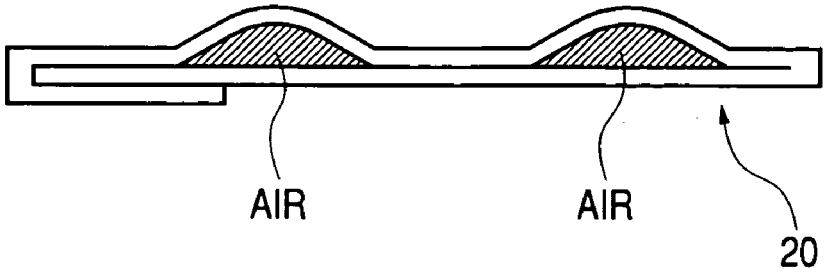
FIG. 14B is a cross-sectional view taken along a line XIVB-XIVB of FIG. 14A.
Figure 15A:
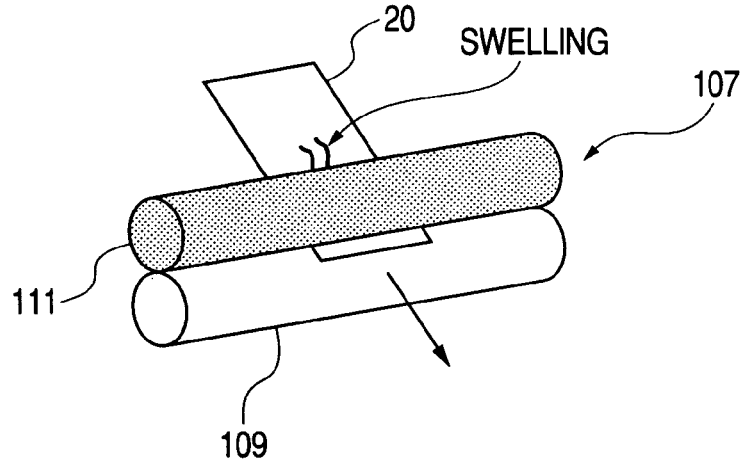
FIG. 15A is a view illustrating a conventional mechanism of occurrence of a wrinkle, and a swelling portion of an envelope.
Figure 15B:
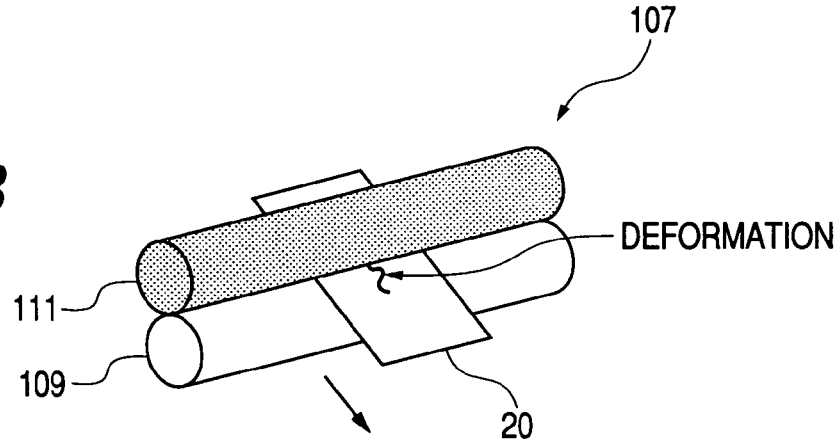
FIG. 15B is a view illustrating the conventional mechanism of occurrence of a wrinkle, and deformation of the envelope.
Figure 15C:
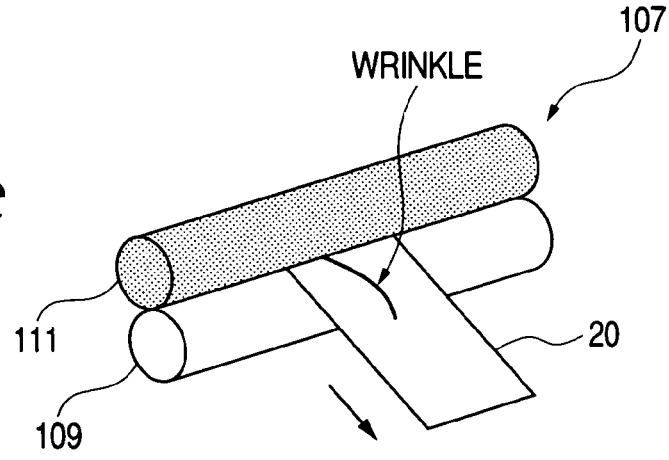
FIG. 15C is a view illustrating the conventional mechanism of occurrence of a wrinkle, and the wrinkle of the envelope.

The length between the opposite ends of a pair of the ribs 15*b* arranged along a direction perpendicular to the sheet transport direction is desirably set to 100 mm or more. This value is determined considering the envelope as illustrated in FIGS. 11A to 11C whose size is relatively small among envelopes generally used in the market, and whose shape is likely to cause the wrinkle. For example, the lateral width of Monarch (a product by MailWell Co.) is 98.4 mm. In this embodiment, the length between the opposite ends of the ribs 15*b* is set to 110 mm as illustrated in FIG. 5.

Since the length between the opposite ends of the ribs 15*b* is set to the above value, the ribs 15*b* can face opposite end portions of the envelope which is especially liable to undergo occurrence of the wrinkle when it is bent. Therefore, the swelling portion appearing on the envelope can be surely regulated.

If the height of the rib 15*b*, i.e., the distance between the rib 15*b* and the envelope being transported (the distance between the rib 15*b* and the envelope, which stands not-swollen), is equal to or more than 3.0 mm, the swelling portion on the envelope cannot be sufficiently pressed. The envelope is hence likely to be conveyed to the fixing device 7 with air remaining in the envelope. On the other hand, if the height of the rib 15*b* is equal to or less than 0.5 mm, back tension at the time of passage of the envelope is liable to increase. As a result, an image thereon is likely to shrink, and the envelope cannot be transported in the event that the amount of its curl is large, leading to possibility of occurrence of jam. Further, the envelope 20 is liable to be charged when it strongly rubs against the ribs 15*b*, leading to possibility of occurrence of a defective image. Therefore, it is preferable the distance between the rib 15*b* and the envelope is set within the range of 0.5 mm to 3.0 mm.

Accordingly, given that the thickness of the envelope is designated by $\alpha$ ($\leqq$0.5 mm), the distance between the rib 15*b* and the transport guide 16 opposite to the rib 15*b* may be set within the range of 0.5+$\alpha$ mm to 3.0+$\alpha$ mm, and is set to 2.0 mm in this embodiment.

In order to confirm the technical advantage of the first embodiment, a generation rate of the wrinkle was measured under a highly humid environment using the COM10 (the product by MailWell Co.). In this measurement, the COM10 under an opened condition is put in a high humidity environment of a humidity of 32%, and the moisture contents and the wrinkle generation rates of the COM10 are compared with each other, respectively.

The moisture content of the COM10 is measured using a handy type infrared-rays moisture meter JE-100 (a product by EOS Corporation), as a result of which it was found that the moisture content of the COM10 under its opened condition was about 8.0%, and the moisture content was about 12% after it was placed under an environment with a humidity of 32% for 48 hours. As a comparative example, the measurement was performed under the same condition for a conventional structure without the ribs 15*b* at the opposite ends of the transport runner holder 15*a*.

FIG. 6 shows the number of envelopes with the wrinkle occurring thereon and the moisture content obtained when ten (10) envelopes were passed through the conventional structure (without ribs) and the structure of the first embodiment (with ribs), respectively. As can be understood from FIG. 6, the wrinkle begins to appear at the moisture content of 11% in the case of the first embodiment with the ribs 15*b*, while the wrinkle begins to appear at the moisture content of 9.5% in the case of the conventional structure without the ribs 15*b*.

It is confirmed from the above-described results that generation of the wrinkle can be reduced by provision of the ribs 15*b* even when the apparatus handles the envelope 20 which contains much moisture, is curved during the transport, and has the swelling portion on its surface.

As discussed above, the rib 15*b* is provided in the transport runner holder 15*a*, and when the envelope containing much moisture, for example, is caused to enter the sheet feeding path 17, and is curved along the sheet feeding path 17, the rib 15*b* is brought into contact with the swelling portion occurring on the bent-side surface of the envelope, thereby exhausting air in the envelope. Accordingly, shrinkage due to abrupt evaporation of moisture at the fixing nip portion can be prevented, and hence deformation caused by this shrinkage can be avoided. Thus, occurrence of the wrinkle can be drastically reduced.

Further, in the structure of the first embodiment, the ribs 15*b* have only to be simply and additively provided at the opposite end portions of the conventional transport runner holder 15*a*, and occurrence of the wrinkle can be hence reduced at relatively low costs.

In this embodiment, the ribs 15*b* are provided at the opposite end portions of the transport runner holder 15*a* such that each rib 15*b* can face at least the end portion of the envelope at which the wrinkle is likely to occur, but another rib can be provided between the two transport runners 15 as indicated by a dashed line in FIG. 5, for example. In such a structure, even a swelling portion occurring on a central portion of the envelope can also be regulated.

Further, in this embodiment, description has been made to the case where the ribs 15*b* are disposed in the transport runner holder 15*a*, but the ribs 15*a* can be disposed at any location upstream the fixing device 7 so long as the ribs 15*b* can face at least the opposite end portions of the envelope at which the wrinkle is likely to occur.

In the foregoing description, although description is made to the case where the swelling portion occurring on the bent-side surface of the envelope is regulated by the ribs 15*b*, the present invention is not limited to such a structure. It is also possible to use a rotor in place of the rib as the regulation member such that the swelling portion of the sheet (the envelope) can be regulated.

Description will now be made to a second embodiment of the present invention.

Figure 7:
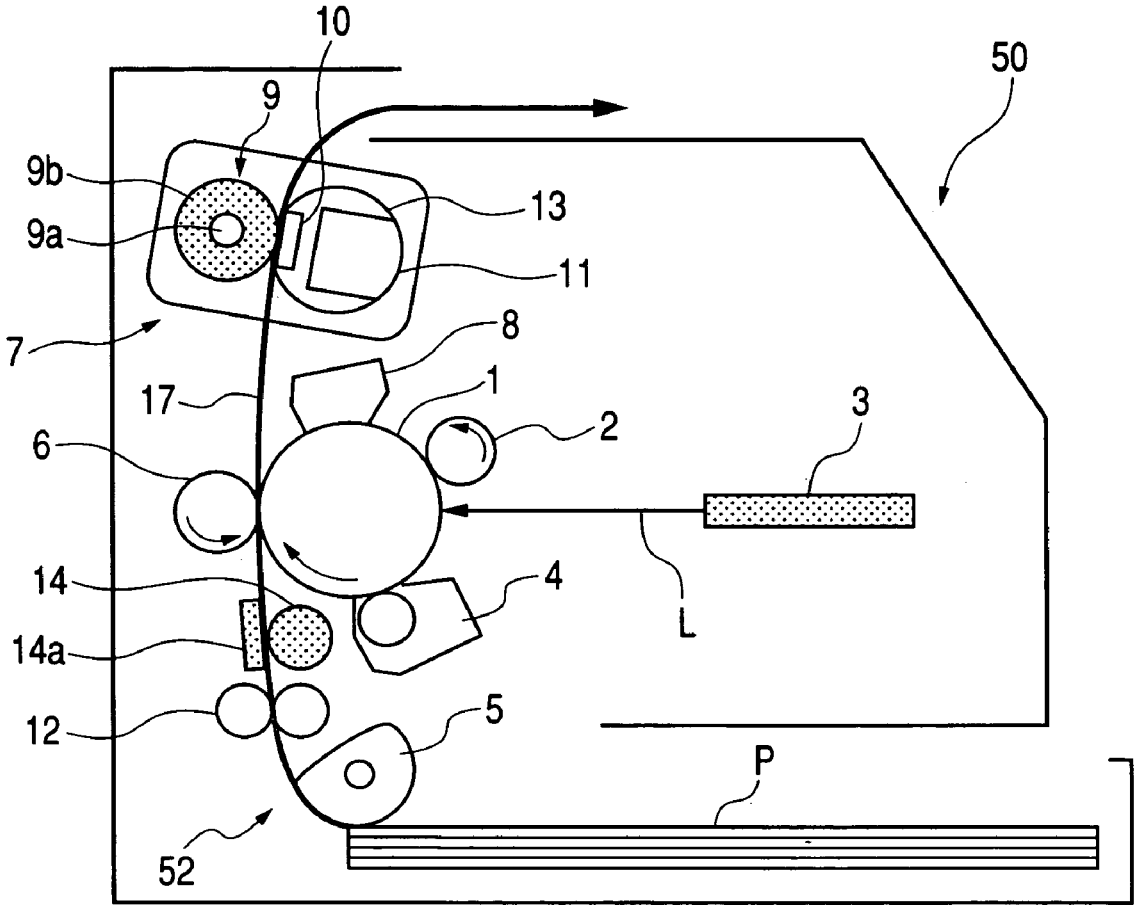
FIG. 7 is a view schematically illustrating the structure of an image forming apparatus of a second embodiment according to the present invention.
Figure 9:
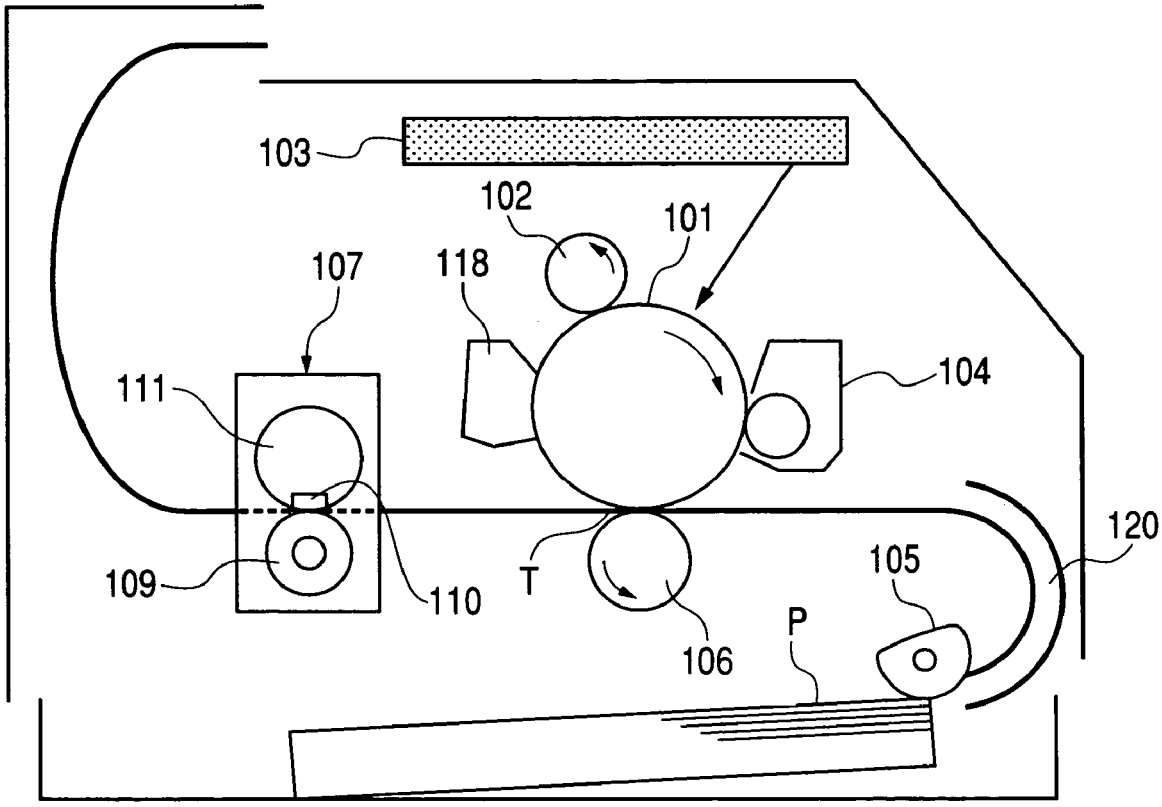
FIG. 9 is a schematic view illustrating the structure of a conventional image forming apparatus.
Figure 10A:
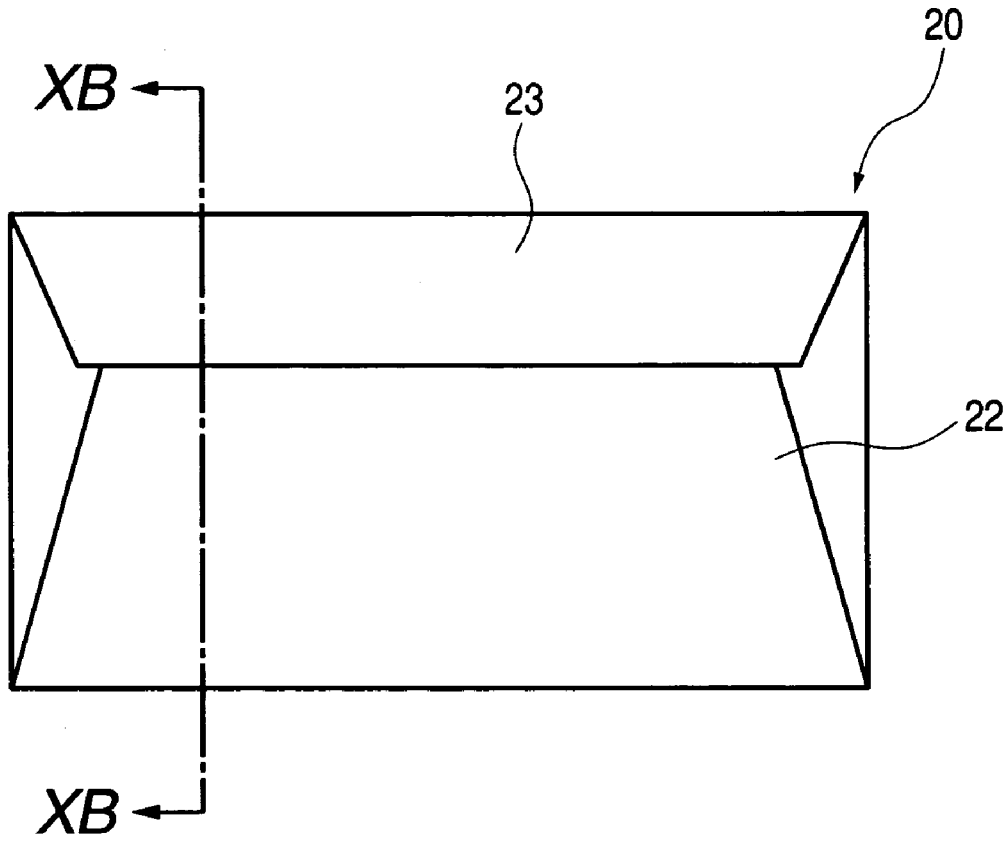
FIG. 10A is a view illustrating an example of an envelope which is generally used.
Figure 10B:
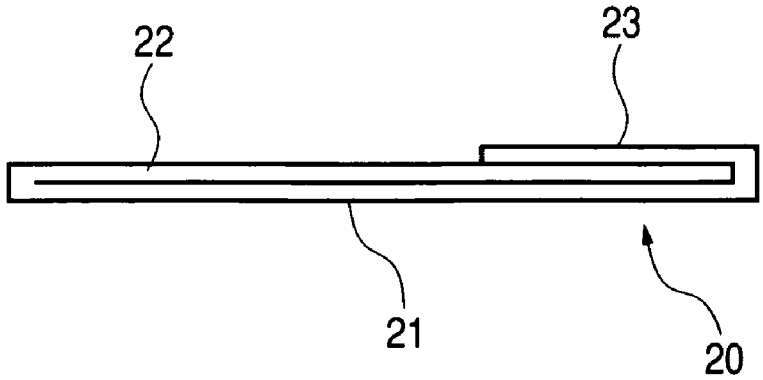
FIG. 10B is a cross-sectional view taken along a line XB-XB of FIG. 10A.

FIG. 7 schematically illustrates the structure of an image forming apparatus of the second embodiment. In FIG. 7, like reference numerals designate the same or corresponding portions of FIG. 1.

In FIG. 7, reference numeral 14 designates an auxiliary roller disposed between the transport roller 12 and the transferring device 6, for example, upstream the fixing device 7. The auxiliary roller 14 presses the swelling portion of the envelope 20 to exhaust air in the envelope.

If the height of the auxiliary roller 14, i.e., the distance between the circumferential surface of the auxiliary roller 14 and the envelope being transported, is equal to or more than 3.0 mm, the swelling portion of the envelope 20 cannot be sufficiently pressed. The envelope is hence likely to be transported to the fixing device 7 with air remaining in the envelope. On the other hand, if the height of the auxiliary roller 14 is equal to or less than 0.5 mm, the envelope cannot be transported in the event that the amount of curl of the envelope 20 is large, leading to possibility of occurrence of jam. Further, the envelope 20 is liable to be charged when it strongly rubs against the auxiliary roller 14, leading to possibility of occurrence of a defective image. Therefore, it is preferable that the distance between the circumferential surface of the auxiliary roller 14 and the envelope is set within the range of 0.5 mm to 3.0 mm.

Accordingly, given that the thickness of the envelope is designated by $\alpha$ ($\leqq$0.5 mm), the distance between the auxiliary roller 14 and the transport guide 14*a* opposite to the auxiliary roller 14 may be set within the range of 0.5+α mm to 3.0+α mm, and is set at 2.0 mm in the second embodiment. With respect to the width of the auxiliary roller 14, it is desirably equal to or more than 100 mm, similarly to the distance between the ribs in the above-discussed first embodiment. The width of the auxiliary roller 14 is set to 150 mm in the second embodiment.

In order to confirm the technical advantage of the second embodiment, the generation rate of the wrinkle was measured under a highly humid environment using the COM10 (the product by MailWell Co.), similarly to the above-discussed first embodiment. As comparative examples, measurements were performed under the same condition for the conventional structure without the ribs 15*b* at the opposite end portions of the transport runner holder 15*a*, and the structure of the first embodiment.

FIG. 8A shows the number of envelopes with the wrinkle occurring thereon and the moisture content obtained when ten (10) envelopes were passed through the conventional structure, the structure of the first embodiment, and the structure of the second embodiment, respectively. As can be understood from FIG. 8A, occurrence of the wrinkle can be further reduced due to provision of the auxiliary roller 14, as compared with the structure of the first embodiment with the ribs 15*b*.

Further, in this measurement, principal parallel characteristic was also measured together with the generation rate of the wrinkle. The principal parallel characteristic is relevant to right and left parallelism of a printed image, and the more unstably the transport is performed, the larger a difference in stretch between the right and left stretched image portions becomes. FIG. 8B shows an average of absolute values and the maximum value of a difference in stretch between right and left stretched image portions measured from the first sheet to the tenth sheet. It can be understood from the results of FIG. 8B that the difference in stretch between right and left stretched image portions is smaller in the second embodiment than in the first embodiment.

From the above results, it is confirmed that even when the envelope, which contains much moisture, is curved during its transport, and resultantly has the swelling portion on its surface, is passed through the apparatus, occurrence of the wrinkle can be reduced and a stable image transport can be achieved by provision of the auxiliary roller 14 for pressing the swelling portion of the envelope.

In the second embodiment, although the auxiliary roller 14 is disposed upstream the transferring device 6 as illustrated in FIG. 7, it is possible to dispose the auxiliary roller 14 in the transport runner holder 15*a* as discussed in the above-discussed first embodiment, for example.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus in which after a toner image formed on an image bearing member provided in an image forming portion is transferred to a sheet, the toner image is fixed in a fixing portion, said image forming apparatus comprising:

a sheet feeding portion, which feeds stored sheets one by one;

a sheet transport path, said sheet transport path being disposed between said sheet feeding portion and said fixing portion, wherein the sheet transport path has a curved sheet transport path portion; and ribs disposed between the curved sheet transport path portion and the fixing portion in said sheet transport path, wherein the ribs press a swelling portion occurring on a surface of the envelope curved by the curved sheet transport path portion in the event the envelope is fed out by said sheet feeding portion as the sheet.

2. An image forming apparatus according to claim 1, wherein a distance between said ribs and the envelope is set to a value in a range between 0.5 mm and 3.0 mm.

3. An image forming apparatus according to claim 1, wherein said ribs are disposed at a location facing each of opposite end portions of the envelope with respect to a direction perpendicular to a transport direction of the envelope being passed through said sheet transport path.

4. An image forming apparatus according to claim 1, further comprising two pairs of rotary members provided in said sheet transport path for transporting the sheet and disposed along a direction perpendicular to a sheet transport direction, and holding means for rotatably holding said respective rotary members which are to be brought into contact with the inner-side surface of the curved envelope at said two pairs of rotary members, and wherein said ribs are disposed in said holding means.

* * * * *

UNITED STATES PATENT AND TRADEMARK OFFICE

CERTIFICATE OF CORRECTION

PATENT NO. : 7,347,420 B2
APPLICATION NO. : 10/781810
DATED : March 25, 2008
INVENTOR(S) : Kobayashi et al.

It is certified that error appears in the above-identified patent and that said Letters Patent is hereby corrected as shown below:

On the Title Page, Item,

[*] Notice: Subject to any disclaimer, the term of this patent is extended or adjusted under 35 USC 154(b) by 459 days Delete the phrase "by 459 days" and insert --by 339 days--

Signed and Sealed this

Eleventh Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,347,420 B2
APPLICATION NO. : 10/781810
DATED : March 25, 2008
INVENTOR(S) : Kobayashi et al.

It is certified that error appears in the above-identified patent and that said Letters Patent is hereby corrected as shown below:

ON THE TITLE PAGE:
At Item (56) References Cited, Foreign Patent Documents, "5-1477640" should read --5-147764--.

COLUMN 2:
Line 26, "United States," should read --the United States,--.
Line 66, "is" should read --are--.

COLUMN 5:
Line 34, "tension less" should read --tensionless--.

COLUMN 6:
Line 42, "pression" should read --pressure--.

COLUMN 8:
Line 28, "upstream the" should read --upstream of the--.
Line 46, "upstream the" should read --upstream of the--.

Signed and Sealed this

Eighteenth Day of November, 2008

JON W. DUDAS
*Director of the United States Patent and Trademark Office*